US005797770A

United States Patent [19]

Davis et al.

[11] Patent Number: 5,797,770

[45] Date of Patent: Aug. 25, 1998

[54] SHIELDED ELECTRICAL CONNECTOR

[75] Inventors: Wayne Samuel Davis, Harrisburg; Robert Neil Whiteman, Jr., Middletown; Michael Eugene Shirk, Grantville, all of Pa.

[73] Assignee: The Whitaker Corporation, Wilmington, Del.

[21] Appl. No.: 701,227

[22] Filed: Aug. 21, 1996

[51] Int. Cl.[6] ..... H01R 13/00

[52] U.S. Cl. ..... 439/607; 439/609

[58] Field of Search ..... 439/607–610, 439/95, 108

[56] References Cited

U.S. PATENT DOCUMENTS

| | | | |
|---|---|---|---|
| 5,017,158 | 5/1991 | Liu et al. | 439/609 |
| 5,035,651 | 7/1991 | Dixon et al. | 439/609 |
| 5,035,652 | 7/1991 | Shibano | 439/607 |
| 5,067,914 | 11/1991 | Seidel et al. | 439/609 |
| 5,085,590 | 2/1992 | Galloway | 439/95 |
| 5,161,999 | 11/1992 | Broschard, III et al. | 439/567 |
| 5,167,531 | 12/1992 | Broschard, III et al. | 439/540 |
| 5,267,882 | 12/1993 | Davis | 439/680 |
| 5,387,114 | 2/1995 | Brunker et al. | 439/108 |
| 5,399,105 | 3/1995 | Kaufman et al. | 439/609 |
| 5,429,520 | 7/1995 | Morlion et al. | 439/108 |
| 5,637,014 | 6/1997 | Sukegawa et al. | 439/607 |
| 5,637,015 | 6/1997 | Tan et al. | 439/607 |
| 5,639,267 | 6/1997 | Loudermilk | 439/607 |

FOREIGN PATENT DOCUMENTS

| | | | |
|---|---|---|---|
| 0 268 441 A2 | 5/1988 | European Pat. Off. | H01R 23/10 |
| 0 455 367 A2 | 11/1991 | European Pat. Off. | H01R 23/70 |
| 0 514 055 A2 | 11/1992 | European Pat. Off. | H01R 9/09 |

OTHER PUBLICATIONS

International Search Report PCT/US96/14774 dated Jan. 22, 1997 (two pages).

*Primary Examiner*—Hien Vu

*Attorney, Agent, or Firm*—Anton P. Ness

[57] ABSTRACT

A shielded electrical connector having an insulating housing (4), a conducting outer shell (6) encircling the housing (4), and a conducting second or inner shell (7) engaging the outer shell (6) to provide electrical shielding (5), electrical contacts (2) extending inside multiple plug receiving cavities (3) in the housing (4), the second shell (7) extending inside each of the plug receiving cavities (3) to engage plug type connectors to be received in the plug receiving cavities (3).

8 Claims, 7 Drawing Sheets

SHIELDED ELECTRICAL CONNECTOR

FIELD OF INVENTION

The invention relates to a shielded electrical connector, and more particularly, to a shielded electrical connector with a shielding shell that encircles an insulating housing.

BACKGROUND OF THE INVENTION

Each of U.S. Pat. No. 5,161,999, and U.S. Pat. No. 5,167,531 discloses a shielded connector assembly constructed with two electrical headers for connection to plug type electrical connectors. Two shells encircle respective headers to provide shielding. The headers and the two shells are mounted to a conducting bracket. A third shell mounts on the bracket and covers a rear of each of the headers. This connector assembly is bulky, because of a relatively large number of separate parts, comprising a mounting bracket, two headers, two shells encircling respective headers, and a third shell. It would be desirable to provide an electrical connector comprising multiple plug receiving cavities, wherein each of the plug receiving cavities is encircled by shielding, and wherein the connector is comprised of a reduced number of separate parts to achieve a compact size.

U.S. Pat. No. 5,387,114 discloses a shielded electrical connector comprising a conducting outer shell encircling an insulating housing, and a conducting second shell engaging the outer shell. Electrical contacts are received inside respective cavities in the housing. The second shell extends along slots in the housing; the slots are beside the cavities without being inside the cavities, with portions of the housing separating the slots from the cavities. These housing portions prevent the second shell from engaging portions of a mating plug type connector that are to be inserted inside the cavities for mating with the contacts therewithin.

It would be desirable to provide an electrical connector with an improved compact size that is achieved by a shield extending inside multiple plug receiving cavities to engage respective plugs that are to mate with electrical contacts inside the cavities.

SUMMARY OF THE INVENTION

The invention pertains to a shielded electrical connector, a compact size of which is achieved by extending a conducting shell inside multiple plug receiving cavities to engage respective plugs that are to mate with electrical contacts inside the cavities. The invention is constructed with a reduced number of parts, as compared with prior electrical connectors, thereby simplifying assembly and reducing fabrication costs.

An advantage of the invention resides in shielding that completely encircles multiple plug receiving cavities, the shielding comprising a second shell engaging an outer shell, the second shell extending inside the multiple plug receiving cavities to achieve a compact construction.

According to an embodiment of the invention, a shielded electrical connector comprises an insulating housing, a conducting outer shell encircling the housing, and a conducting second shell engaging the outer shell to provide electrical shielding, electrical contacts extending inside multiple plug receiving cavities in the housing, the second shell extending inside each of the plug receiving cavities to engage electrical plug type connectors to be received in the plug receiving cavities.

DESCRIPTION OF THE DRAWINGS

A preferred embodiment will now be described with reference to the accompanying drawings, according to which.

DETAILED DESCRIPTION

Figure 1:
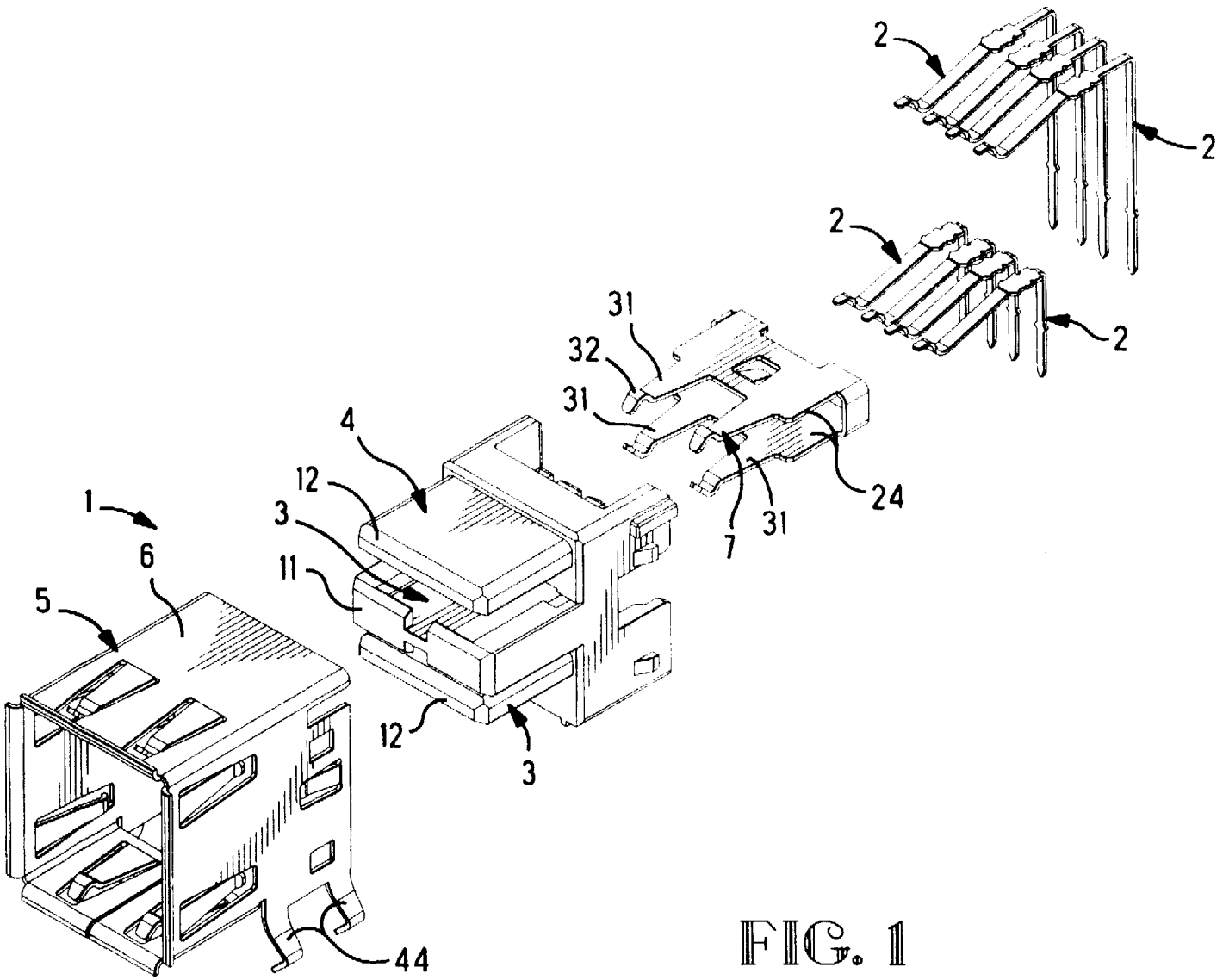
FIG. 1 is an isometric view of an electrical connector with parts being separated from one another.
Figure 2:
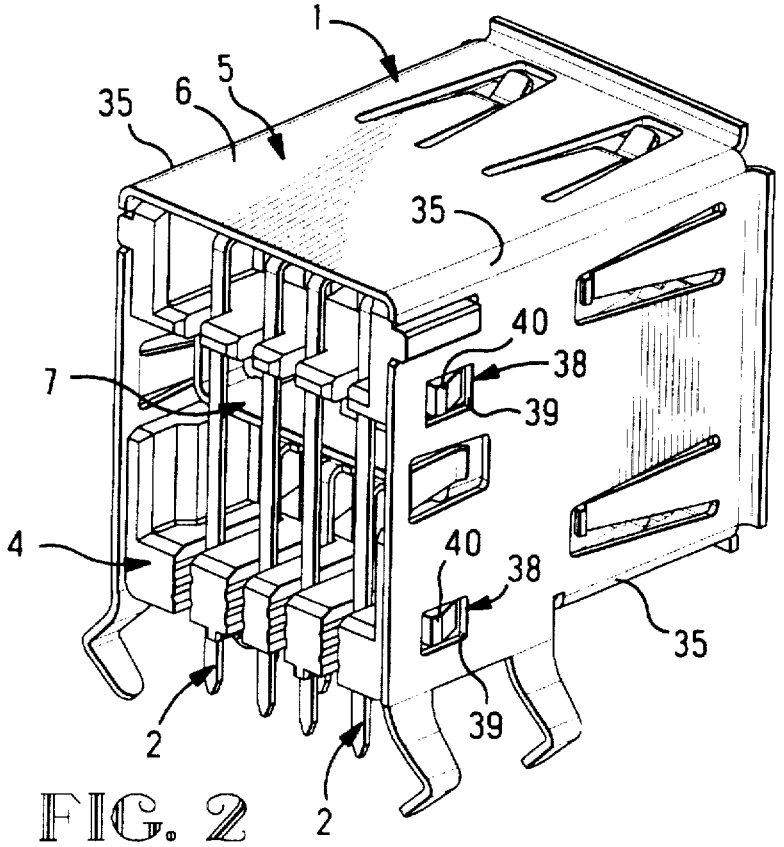
FIGS. 2 and 3 are isometric rear and front views of the connector shown in FIG. 1.
Figure 3:
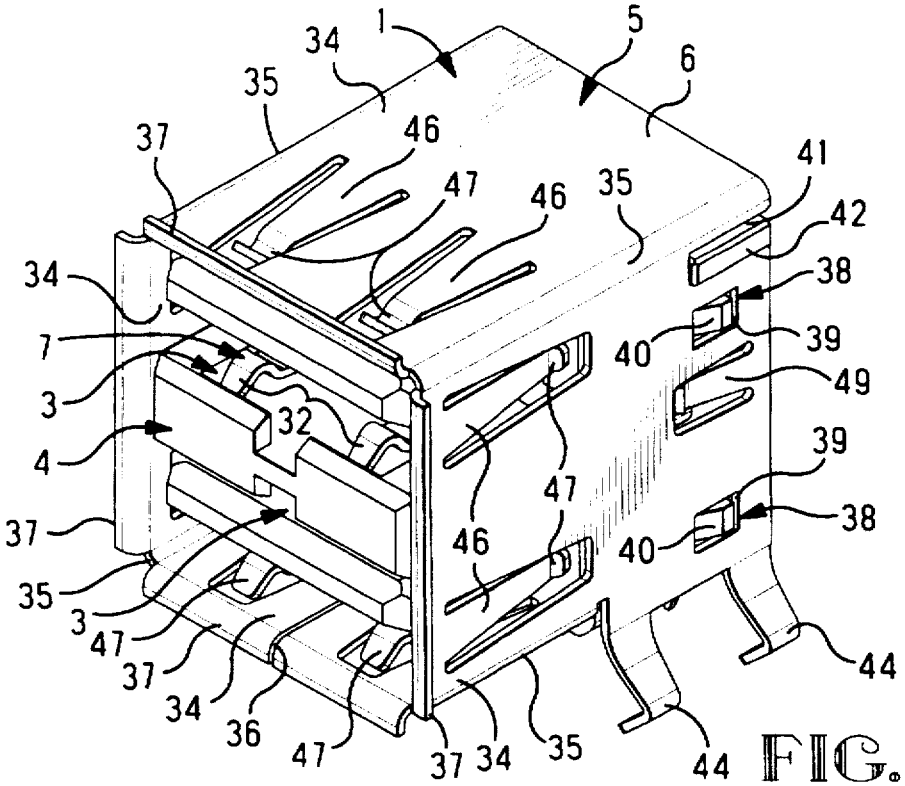
Figure 4:
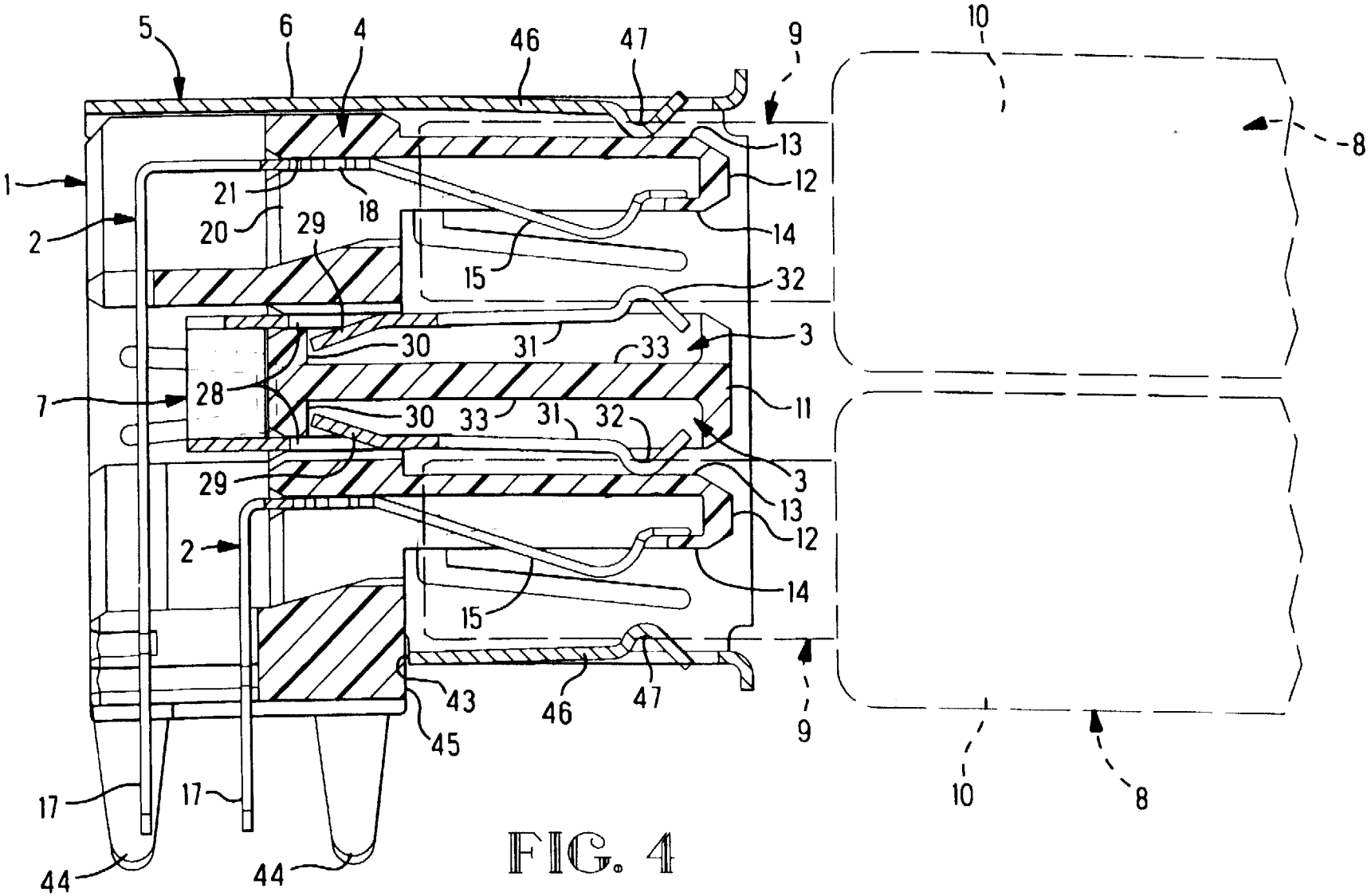
FIG. 4 is a side view in section of the connector shown in FIG. 1, together with two mating plug type electrical connectors shown in dotted outlines.

With reference to FIGS. 1–4, an electrical connector 1 comprises two rows of electrical contacts 2 inside respective plug receiving cavities 3 in an insulating housing 4, and shielding 5 comprising a conducting outer shell 6 encircling the housing 4 and a conducting second shell 7 inside the outer shell 6 and inside the plug receiving cavities 3. For example, the connector 1 is shown as having two plug receiving cavities 3. As shown in FIG. 4, in phantom or dotted outlines, respective electrical plug connectors 8 are to be inserted into respective plug receiving cavities 3 to mate with the connector 1. Each of the plug connectors 8 comprises, a conductive shell 9 projecting from an insulating overmold 10. Although not illustrated, it should be understood that each of the plug connectors 8 further comprises, an insulating housing surrounded by the shell 9, and electrical mating contacts in the housing to be inserted into respective plug receiving cavities 3 of the connector 1 to engage and electrically connect with the contacts 2 in the connector 1. General construction of a mating electrical plug connector 8 is described in U.S. Pat. No. 5,017,156 and in U.S. Pat. No. 5,267,882.

Figure 5:
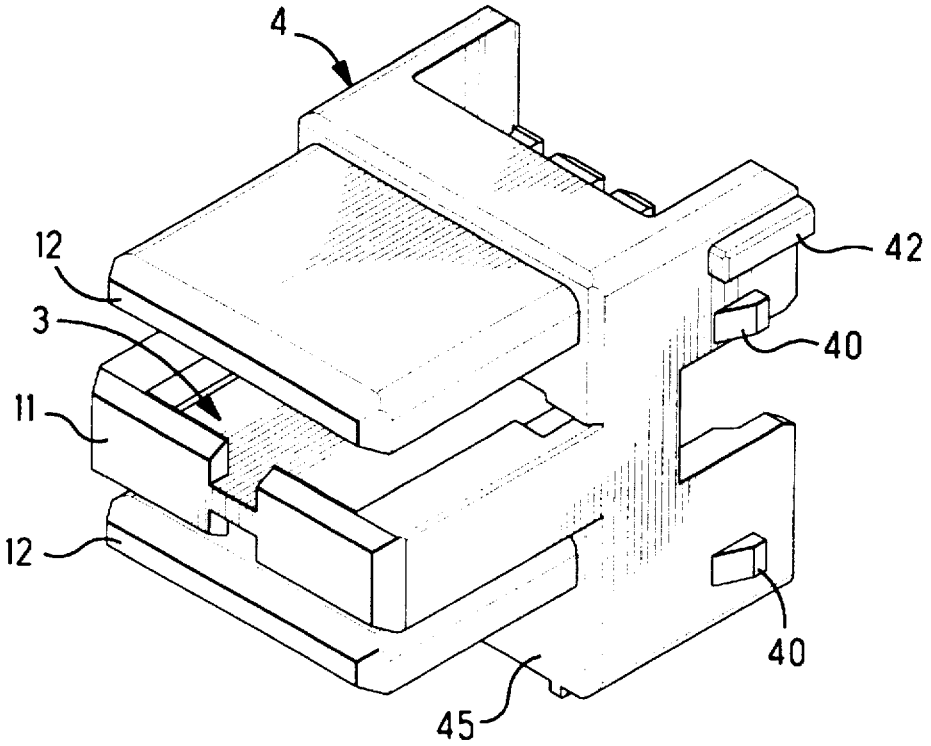
FIG. 5 is an isometric view of an insulating housing that is a part of the connector shown in FIG. 1.
Figure 6:
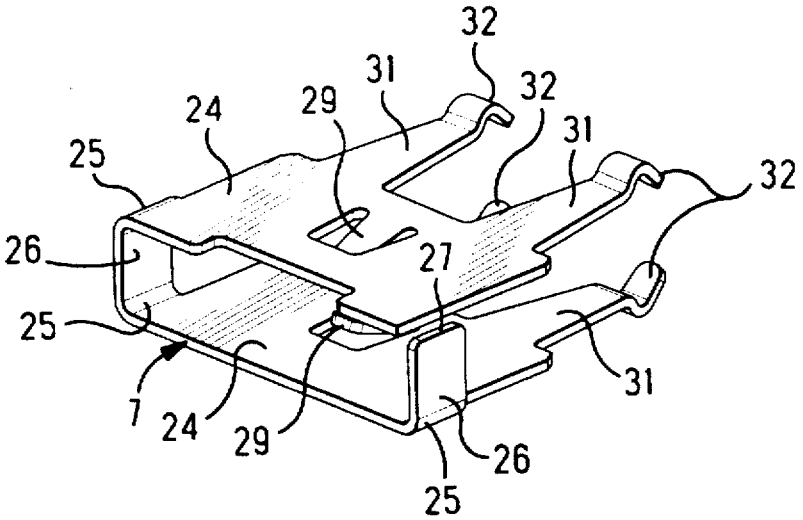
FIG. 6 is an isometric view of a second shell that is a part of the connector shown in FIG. 1.
Figure 7:
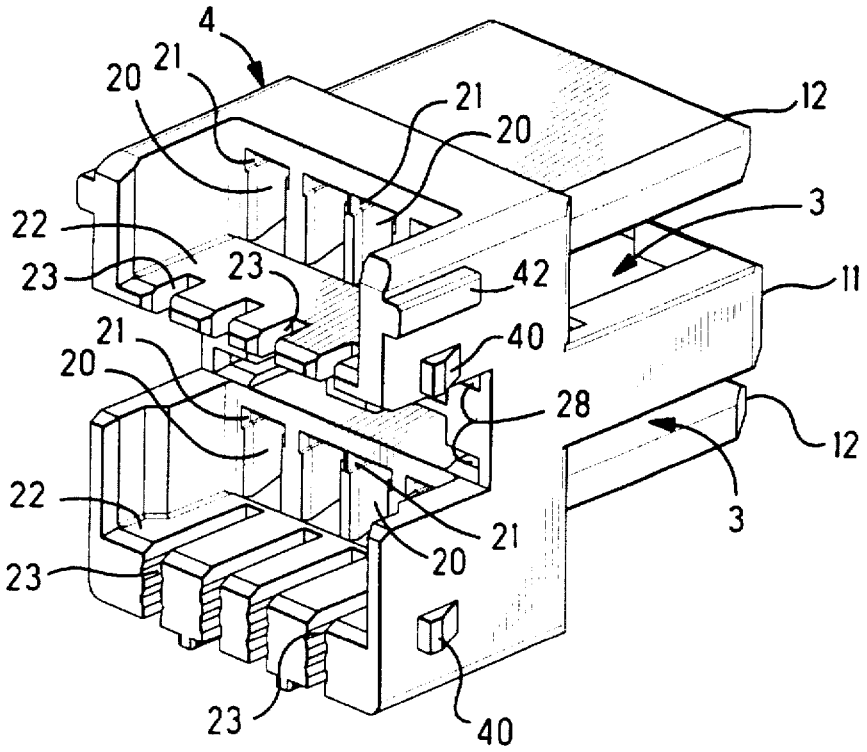
FIG. 7 is an isometric view of a rear of the housing that is shown in FIG. 5.
Figure 10:
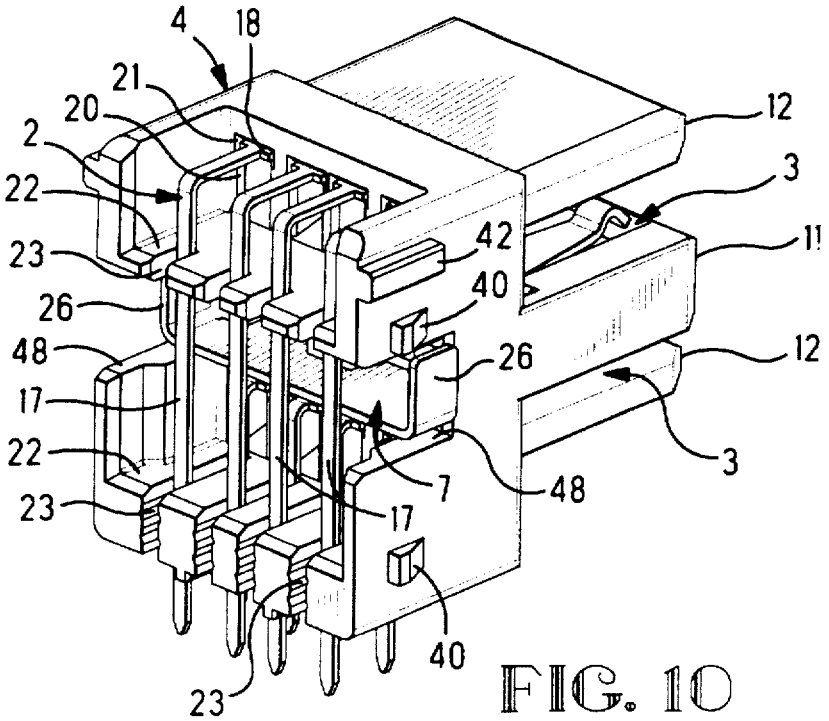
FIG. 10 is an isometric view of a rear of the housing shown in FIG. 5, together with the contacts shown in FIGS. 8 and 9.
Figure 11:
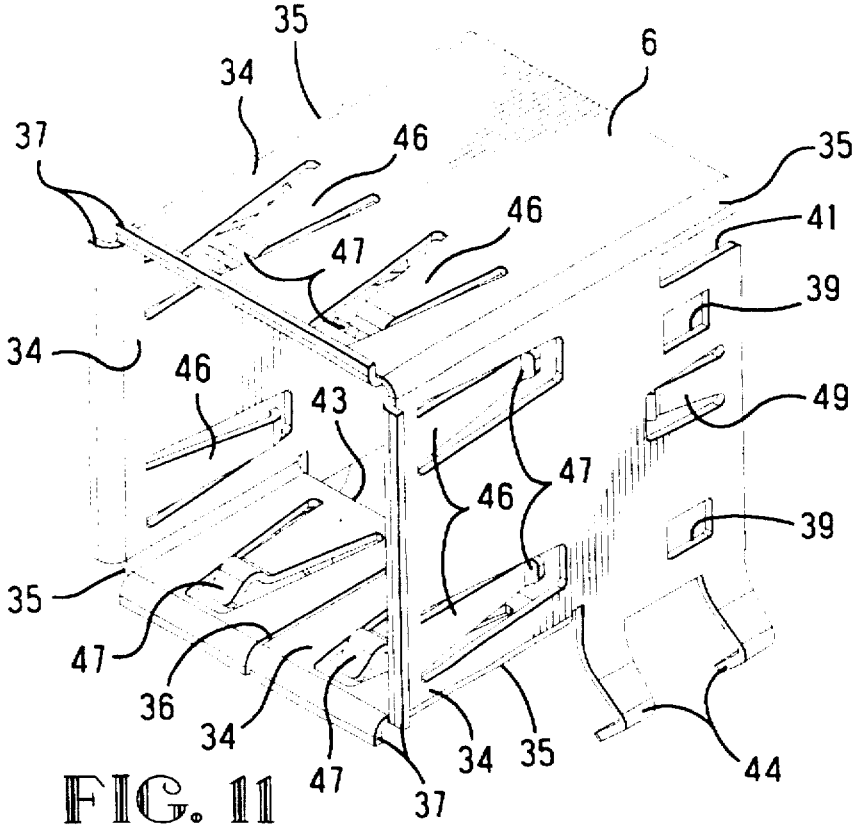
FIG. 11 is an isometric view of a front of a conductive outer shell that is a part of the connector shown in FIG. 1.
Figure 12:
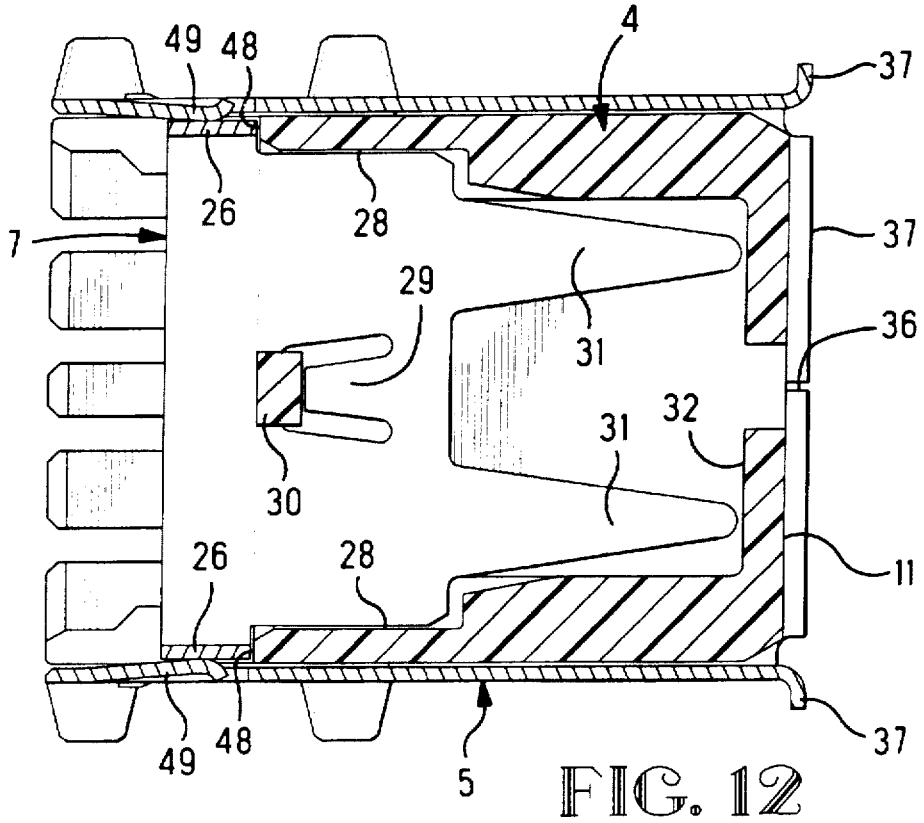
FIG. 12 is a top view in section of the connector shown in FIG. 1 illustrating the second shell in a plug receiving cavity of the housing.

With reference to FIGS. 5, 7 and 10, the housing 4 is of unitary, molded plastic construction. A partition 11 on the housing projects forwardly between the two plug receiving cavities 3 with opposite sides or surfaces thereof facing respective plug receiving cavities 3. The cavities 3 have similar constructions, with the construction of one of the cavities 3 being inverted with respect to the construction of the other of the cavities 3. Second partitions 12 parallel to the partition 11 divide respective plug receiving cavities 3 into two parts, each of the cavities being divided into a shell receiving cavity section 13 and a contact receiving cavity section 14.

Figure 8:
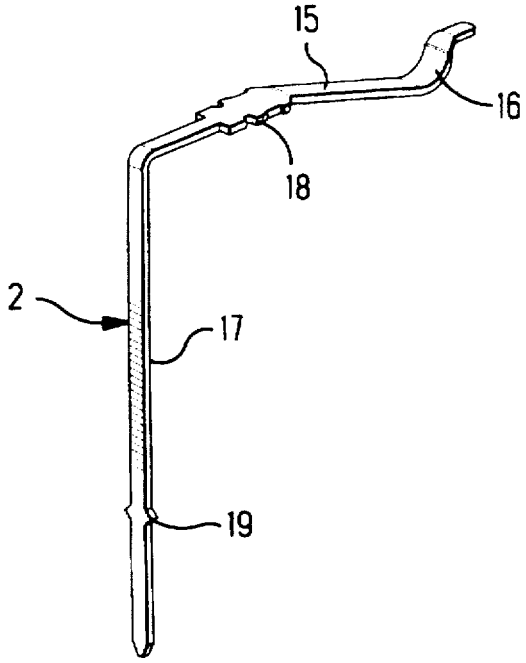
FIGS. 8 and 9 are isometric views of conductive electrical contacts that are part of the connector shown in FIG. 1.
Figure 9:
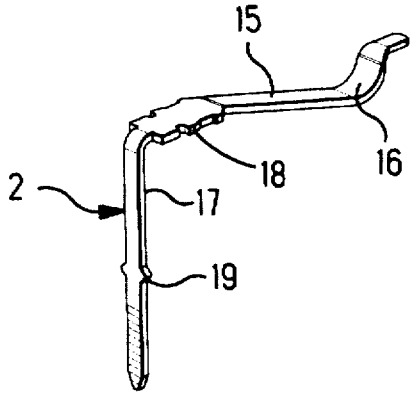

With reference to FIGS. 8 and 9, the electrical contacts 2 will be described. Each of the contacts 2 is of unitary construction, stamped and formed from metal. A cantilever spring 15, formed with a curved contact portion 16, extends forwardly from an elongated terminal 17 that is bent downward. The terminal 17 on the contact 2 shown in FIG. 8 is relatively longer than a relatively shorter terminal 17 on the contact 2 shown in FIG. 9. A widened mounting section 18 rearward of the spring 15 has barbed edges A widened mounting section 19 on the terminal 17 has barbed edges.

With reference to FIGS. 7 and 10, multiple contact receiving passages 20 project forwardly from a rear of the housing and are arranged in an upper row and a lower row. A widened slot 21 extends across a top of each of the passages 20. The longer contacts 2 project through respective passages 20 in the upper row while the shorter contacts 2 project through respective passages 20 in the lower row. The widened sections 18 on the contacts 2 are wedged in respective slots 21 to restrain the contacts 2 from movement.

Beneath each row of passages 20, a corresponding contact spacer plate 22 projects rearwardly from a remainder of the housing 4. Elongated terminal receiving slots 23 communicate with a rear of each of the contact spacer plates 22. The slots 23 in an upper one of the plates 22 are aligned with respective slots 23 in a lower one of the plates 22. The terminals 17 of the contacts 2 project rearwardly from respective passages 20 and project downwardly and through corresponding slots 23. The shorter terminals 17 of the contacts 2 project through corresponding slots 23 in the lower plate 22 while the longer terminals 17 project through slots 23 in both plates 22. Thus, each slot 23 in the lower plate 22 receives two terminals 17. Thereby the terminals 17 are aligned by the plates 22 for mounting in apertures through a circuit board, not shown. The widened section 19 on each terminal 17 is wedged in a corresponding slot 23 in the lower plate 22 to restrain the terminal 17 from movement.

Figure 13:
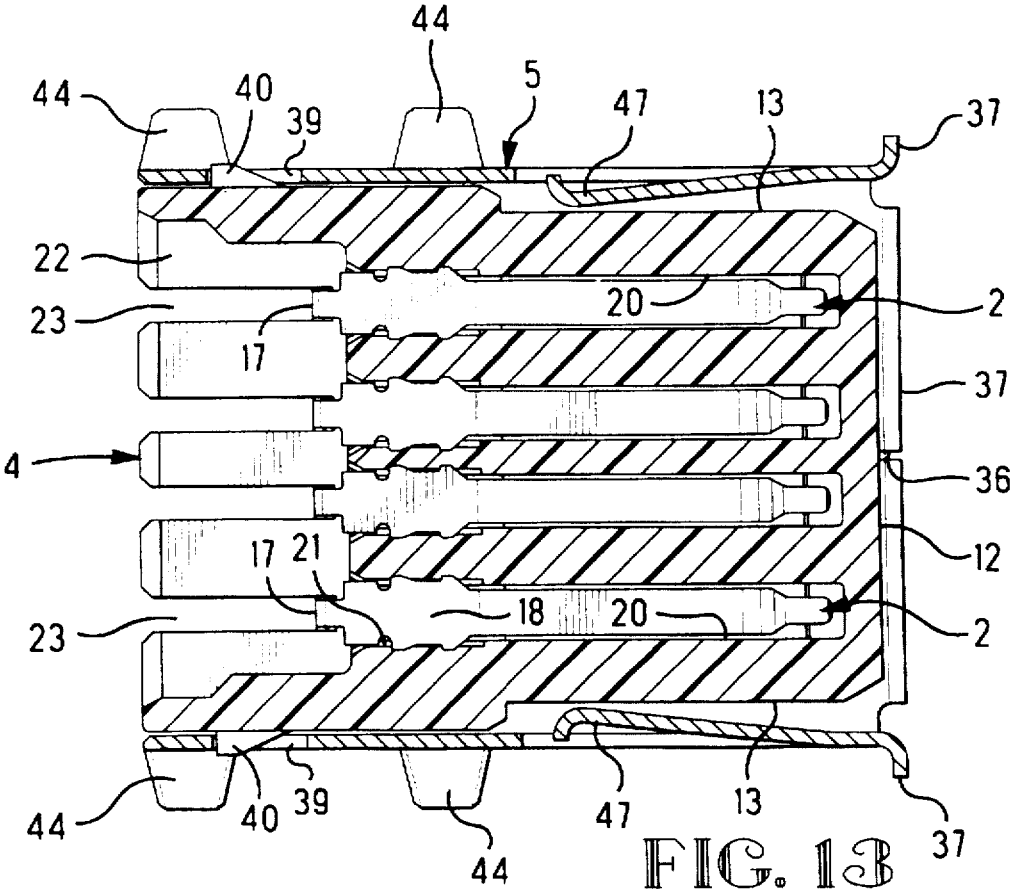
FIG. 13 is a top view in section of the connector shown in FIG. 1 illustrating a row of contacts in a plug receiving cavity of the housing.

With reference to FIGS. 4 and 13, the curved contact portions 15 on respective electrical contacts 2 extend along the passages 20. The passages 20 open into respective plug receiving cavities 3, forming grooves along respective partitions 12. The contact portions 15 extend along the grooves, facing into and exposed within the contact receiving cavities 14.

With reference to FIGS. 4, 6, 10 and 12, the conducting second shell 7 is of unitary construction, stamped and formed from a sheet of metal that has a thickness plane, forming the thickness plane of the second shell 7. The second shell 7 comprises spaced apart plates 24 that connect at bent corners 25 with respective webs 26 that extend transversely of the plates 24 An open seam 27 separates one of the webs 26 from a corresponding plate 24. The plates 24 fit slidably along spaced apart slots 28, FIGS. 4 and 7, in the housing 4. The slots 28 extend in the housing 4 from rear to front. As shown in FIG. 2, the second shell 7 is forward of the upper row of terminals 17 on the contacts 2. Thus, the second shell 7 is assembled to and affixed within the housing 4 before such contacts 2 are assembled to the housing 4. Cantilever latch fingers 29 project rearwardly on each plate 24, being struck out of the thickness plane of the plates 24. The latch fingers 29 are deflected resiliently when the plates 24 are inserted along the spaced apart slots 28, and spring outwardly when they have entered respective slots 28. The latch fingers 29 face toward a rear wall 30, FIGS. 4 and 12, in each of the slots 28 to restrain rearward movement of the second shell 7 relative to the housing 4.

The plates 24 on the second shell 7 fit slidably over, and register along, the partition 11 on the housing 4. Further, the plates 24 on the second shell 7 extend on the opposite sides of the partition 11. Cantilever spring fingers 31 project forwardly from each plate 24. The spring fingers 31 on the second shell 7 project forwardly of the plates 24, and extend in respective plug receiving cavities 3 to engage respective plug type electrical connectors 8 to be received in the plug receiving cavities 3. Each of the spring fingers 31 has a curved tip 32 that projects into a corresponding trough 33 recessed in the partition 11. The tips 32 extend along a corresponding plug receiving cavity 3 to engage respective plug type electrical connectors 8 to be received in the plug receiving cavities 3. The spring fingers 31 on the second shell 7 extend in respective plug receiving cavities 3 together with the electrical contacts 2 in each of the plug receiving cavities 3, whereby plug type electrical connectors 8 to be received in the plug receiving cavities 3 will be engaged by the spring fingers 31 on the second shell 7, and by the electrical contacts 2.

With reference to FIG. 4, each plug 8 will enter a corresponding contact section 14 to engage the contacts 15 in a corresponding row of the contacts 15. The conducting shell 9 on the plug connector 8 will enter both the contact section 14 and a corresponding shell receiving section 13 of the same plug receiving cavity 13.

With reference to FIGS. 2, 3, 11, and 12, the conducting outer shell 6 is of unitary construction, stamped and formed from a sheet of metal that has a thickness plane, forming the thickness plane of the outer shell 6. The outer shell 6 comprises four walls 34 that are joined together at bent corners 35 with one of the walls 34 bifurcated by an open seam 36. The four walls 34 encircle an open front end on the outer shell, and outwardly turned lips 37 on respective walls 34 are adjacent the open front end, and conductive outer shell 6 encircles front portions of the housing.

The housing 4 and the outer shell 6 are latched together by a latch 38, FIGS. 2 and 3, that comprises openings 39 in corresponding walls 34 on the outer shell 6 receiving projecting wedge shaped projections 40 on the housing 4. The projections 40 are inclined in a direction from front to rear, such that the projections 40 can be urged into the open rear end of the outer shell 6, and latch in the openings 39 in corresponding walls 34.

Slotted openings 41, FIGS. 2 and 3, extending from rear to front in corresponding opposite walls 34 communicate with the open rear end on the outer shell 6. Elongated ribs 42 projecting from the housing 4 on opposite walls extend along the slotted openings 41 to prevent pivoting of the outer shell 6 relative to the housing 4. The ribs 42 enter the slotted openings 41 from the rear when the housing 4 is inserted into the open rear end.

The four walls 34 on the outer shell 6 encircle an open rear end on the outer shell 6. The wall 34 that is bifurcated by the seam 36 has a rear opening 43, FIG. 11. Instead of removing metal to form the opening 43, the metal that would have been removed to form the opening 43 becomes elongated electrical terminals 44 that are in alignment with the opening 43. The terminals 44 are connected to, and project from, corresponding opposite walls 34. The terminals 44 are for connection in openings through a circuit board, not shown, on which the connector 1 is to be mounted. A shoulder 45, FIGS. 4 and 5, on the housing 4 faces forwardly and is received in the opening 43 to resist forward movement of the housing 4 relative to the outer shell 6. The housing 4 is inserted into the open rear end of the outer shell 6 until the shoulder 45 faces an edge on the opening 43.

Spring fingers 46 on each of the four walls 34 on the outer shell 6 are adjacent the open front end of the outer shell 6. Each of the spring fingers 46 is a cantilever beam with a curved tip 47 that projects inside the outer shell 6. The spring fingers 46 on corresponding opposite walls 34 extend from front to rear. The spring fingers 46 on a remainder of the corresponding opposite walls 34 extend from rear to front. Each of the spring fingers 46 is bent out of the thickness plane of the outer shell 6 to project inwardly of the walls 34. With reference to FIG. 4, the spring fingers 46 on the bifurcated wall 34 face toward and extend along a corresponding plug receiving cavity 3, along the contact receiving section 14. The spring fingers 46 on an opposite wall 34 is received in a shell receiving section 13 of the other plug receiving cavity 3, which shell receiving section 13 is between the outer shell 6 and a corresponding outer wall on the housing 4. As shown in FIGS. 4 and 13, the shell receiving recess 13 extends over lateral sides on each of the partitions 12. The spring fingers 46 on each of the two walls 34 that join the bifurcated wall 34, extend along the shell receiving recess 13, in turn, that extends over lateral sides on each of the partitions 12. The spring fingers 46 engage the shells 9 on respective plug connectors 8, when the plug connectors 8 are received in the plug receiving cavities 3 to mate with the connector 1. Thus, electrical connection is advantageously established by engagement of the outer shell 6 and the second shell 7 with each other, as well as to each shell 9 on a plug connector 8.

With reference to FIGS. 2, 3, 10 and 12, the second shell 7 bridges across recesses 48 in the housing. The outer shell 6 projects into the recesses 48 and engages the second shell 7. More particularly, additional spring fingers 49 on respective walls 34 on the outer shell 6 are adjacent the rear end of the outer shell 6 and are similar in construction as compared with the spring fingers 46. The additional spring fingers 49 on the outer shell 6 project into the recesses 48 in the housing 4 to engage respective webs 26 on the second shell 7 whereby the second shell 7 engages the outer shell 6 and establishes an electrical connection therebetween.

An advantage of the invention resides in shielding that completely encircles multiple plug receiving cavities, the shielding comprising a second shell engaging an outer shell, the second shell extending inside the multiple plug receiving cavities to achieve a compact construction.

Another advantage resides in shielding comprising: a second shell engaging outer shell, wherein both the outer shell and the second shell extend in respective multiple plug receiving cavities of a connector, enabling both the outer shell and the second shell to engage respective electrical plug connectors to be received in the plug receiving cavities.

What is claimed is:

1. A shielded electrical connector comprising:

an insulating housing, at least two plug receiving cavities in the housing, electrical contacts in each of the plug receiving cavities, shielding being provided by a conductive outer shell and a separate conductive second shell engaging the outer shell, the outer shell encircling the housing and the second shell insertable into the housing from a rear face and affixed within the housing, said second shell projecting between the plug receiving cavities in the housing and including at least one spring finger extending into each of said plug receiving cavities to proximate a front face of the insulation housing for engaging a shield of a mating plug type connector upon insertion into a respective one of said plug receiving cavities, whereby each of the plug receiving cavities in encircled by the shielding.

2. A shielded electrical connector comprising:

an insulating housing, plug receiving cavities in the housing to receive respective plug type connectors, shielding being provided by a conductive outer shell and a separate conductive second shell inside the outer shell, respective walls on the outer shell encircling the housing and encircling an open front end on the outer shell, and first spring fingers on said respective walls, the first spring fingers begin adjacent the open front end on the outer shell to engage respective mating plugs to be inserted inside the outer shell, said second shell being insertable into said housing from a rear face thereof, and first spring fingers on the second shell extending to proximate an open front end of the outer shell and extending into respective said plug receiving cavities to engage shields of respective plug type connectors to be inserted into the respective plug receiving cavities, and second spring fingers on the outer shell engaging the second shell to establish an electrical connection therebetween.

3. A shielded electrical connector comprising:

an insulating housing defining multiple plug receiving cavities extending inwardly from a mating face, and electrical contacts having contact sections exposed inside said multiple plug receiving cavities, a conducting outer shell encircling front portions of the housing, and a separate conducting second shell insertable into said housing from a rear face thereof and affixed within said housing and engaging the outer shell, the second shell including at least one spring finger extending inside each of the plug receiving cavities to proximate a front face of the insulating housing to engage shields of plug type connectors upon receipt thereon in the plug receiving cavities.

4. A shielded electrical connector as set forth in claim 3 wherein spring fingers of said outer shell project into respective said plug receiving cavities to be engaged by said plug type connectors upon mating.

5. A shielded electrical as set forth in claim 3 wherein a partition extends between said plug receiving cavities with surfaces of said partition defining walls of said cavities, said second shell extends along said partition surfaces, and spring fingers on said second shell extend along and partially into respective said plug receiving cavities to engage said electrical plug type connectors upon mating.

6. A shielded electrical connector as set forth in claim 5 wherein said second shell fits slidably over said partition and registers along said partition surfaces.

7. A shielded electrical connector as set forth in claim 3 wherein spaced apart plates on said second shell fit slidably into spaced apart slots extending forwardly from a rear face of said housing to lie adjacent respective ones of said plug receiving cavities, and webs on said second shell extend transversely of the plates and bridge across recesses in the housing.

8. A shielded electrical connector as set forth in claim 7 wherein spring fingers of said outer shell project into said recesses and engage said webs.

* * * * *